United States Patent [19]

Dahlberg et al.

[11] 4,064,805

[45] Dec. 27, 1977

[54] DEVICE FOR PYROTECHNICAL ILLUMINATING CHARGE

[75] Inventors: Stig Erland Dahlberg, Bjorneborg; Nils Goran Axel Gellerstedt, Karlskoga, both of Sweden

[73] Assignee: AB Bofors, Bofors, Sweden

[21] Appl. No.: 687,804

[22] Filed: May 19, 1976

[30] Foreign Application Priority Data

May 23, 1975 Sweden ..... 7505877

[51] Int. Cl.[2] ..... F42B 25/04; F42B 13/38

[52] U.S. Cl. ..... 102/35; 102/87

[58] Field of Search ..... 102/35, 37.1, 37.8, 102/35.6, 87

[56] References Cited

U.S. PATENT DOCUMENTS

| | | | |
|---|---|---|---|
| 2,986,999 | 6/1961 | Fiedler et al. | 102/60 |
| 3,453,958 | 7/1969 | Lai | 102/37.8 |
| 3,485,169 | 12/1969 | Lai | 102/37.8 |
| 3,494,283 | 2/1970 | Cronk | 102/37.8 |
| 3,678,854 | 7/1972 | Davidson | 102/37.8 |
| 3,724,375 | 4/1973 | Calkins et al. | 102/35 |

FOREIGN PATENT DOCUMENTS

| | | | |
|---|---|---|---|
| 2,527,332 | 1/1976 | Germany | 102/37.8 |

*Primary Examiner*—Edward A. Miller

*Attorney, Agent, or Firm*—Pollock, Vande Sande & Priddy

[57] ABSTRACT

An illuminating flare includes an excess of reducing agent in its illuminating charge and a flame distributor for deflecting the excess outwardly where it burns in the surrounding air.

20 Claims, 15 Drawing Figures

Fig. 2 a
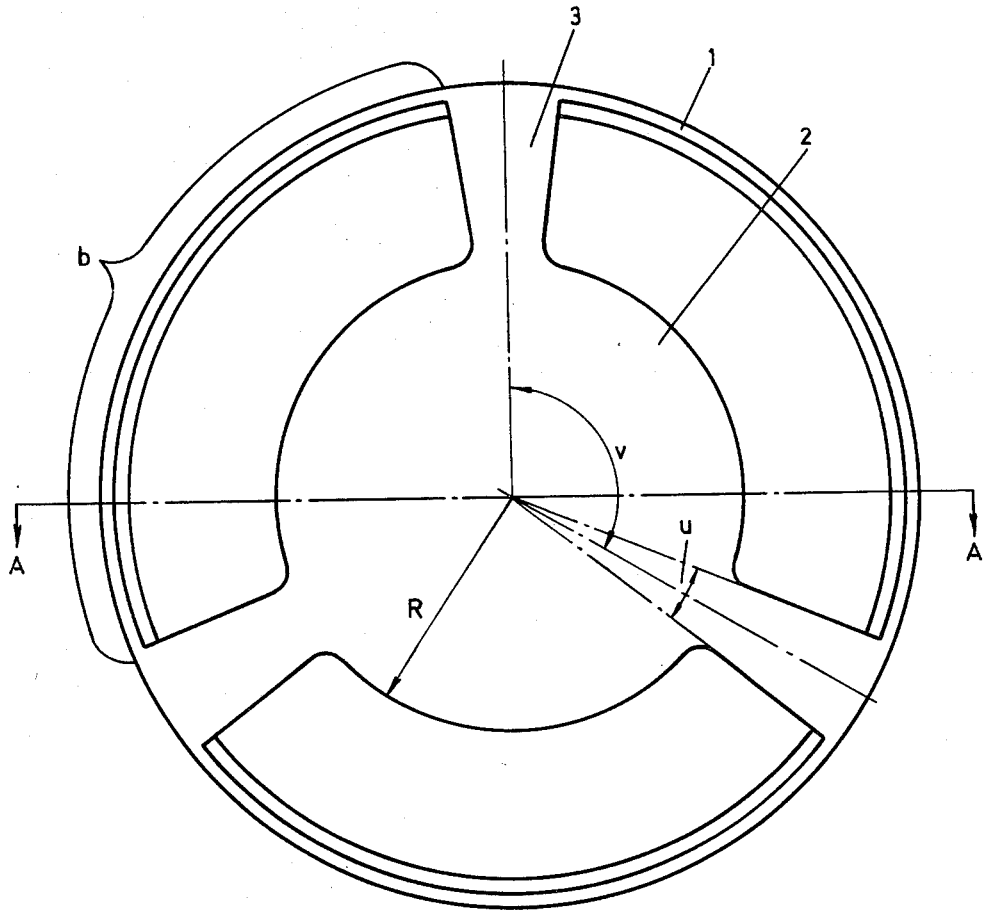
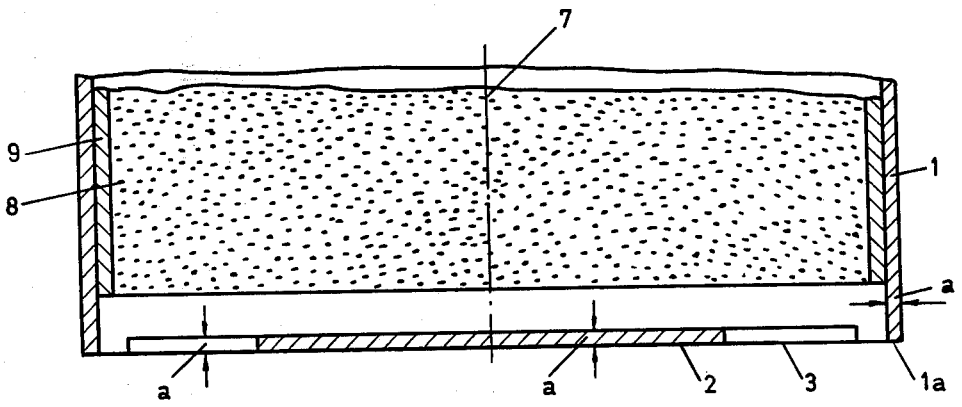
Fig. 2 b
Snitt A - A

Snitt A-A

DEVICE FOR PYROTECHNICAL ILLUMINATING CHARGE

BACKGROUND OF THE INVENTION

The present invention relates to a device for a pyrotechnical illuminating charge which comprises a reducing agent, an oxidizing agent and an organic bonding agent, and which is applied in a container, via one end of which the charge in its activated condition gives out a light-emitting flame.

As an example of pyrotechnical illuminating charge may be mentioned the charge according to the Swedish Pat. No. 345,845 which in one embodiment proposed magnesium as a reducing agent and sodium nitrate as an oxidizing agent. This type of illuminating charge is also provided with a layer of plastic on its envelope surface which operates so that the illuminating charge, after ignition at one of its end surfaces, burning only from this end, without being ignited on its envelope surface.

OBJECTS AND SUMMARY OF THE INVENTION

The main purpose of the present invention is to achieve improved light emission from an illuminating projectile with technically very simple and therefore economic means and, at the same time to allow a maximum payload of illuminating charge material to be carried by the projectile. This last-mentioned purpose requires that the technical arrangements made, notwithstanding a simple construction, must not require much space, particularly in the longitudinal direction of the projectile.

In accordance with the concept of the invention, a flame distributor is to be arranged at the illuminating charge and the illuminating charge is to be made with an excess content of reducing agent in relation to the oxidizing agent. Because of the reduced quantity of oxidizing agent, a lower temperature is obtained in the inner parts of the flame, so that the flame distributor can be made in the form of a very thin choking disc, applied centrally in the flame. The flames gases that pass the flame distributor contain large quantitites of unconsumed magnesium, which is then totally combusted in the outer parts of the flame if the flame distributor is designed so that there will be a sufficiently great admixture of air. This involves an increased temperature in the outer parts of the flame which, in turn, involves a comparatively more intensive radiation, and practical tests have shown that considerable improvements in the light emission are obtained also in relation to illuminating charges with previously known flame distributors. Among other things, it has proved that the flame obtained will be particularly stable even when there are pendulum movements in the flare unit, and that, for instance, the flame does not change its direction due to said movements. Utilizing an excess of reducing agent which is combusted with the oxygen in the air also gives advantages strictly from the point of view of space, as a charge which develops comparatively great energy per unit of volume of the charge is obtained.

Through Swedish Pat. No. 346,303, a flame distributor which comprises guide screens for the flame is previously known. Such guide screens require comparatively much space, and the known flame distributor becomes complicated in the case when the guide screens are made so that they can be folded up and down. Through e.g. Swedish Pat. No. 35,619 it is moreover known for a special type of illuminating ammunition, to utilize a disc-formed element at the flame-emitting surface of the charge, which is primarily intended to serve as a fastening disc or holding member for the illuminating charge, which contains a number of part charges. However, said fastening disc is not designed so that it functions as a flame distributor. The known fastening disc is moreover fastened in a special way in relation to the container, which requires a special design of the projectile itself.

In a further development of the concept of the invention, a specific design of the flame distributor is therefore proposed, which in a decisive way solves all of the problems described above. The feature that can mainly be considered to be characteristic for a device according to the invention is that at said container a flame distributor is arranged and that the charge is made with a substantial excess of the metallic reducing agent in relation to the oxidizing agent in comparison with the quantity ratio between said agent that is applicable for effective combustion of an illuminating charge that does not have the flame distributor. The excess of reducing agent in the activated condition of the illuminating charge is intended, in an unburnt condition, to pass by and be spread out by the flame distributor together with the flame gases generated at the combustion of the charge, and the flame distributor is then also arranged with a spreading function which achieves turbulence of and thereby an admixture of air in the unburnt excess of reducing agent and said flame gases so that said unburnt excess of reducing agent is combusted with the oxygen in the air in the outer parts of the flames and gives rise to flames with a comparatively great energy content. The device according to said further developments is mainly characterized by a thin, solid disc arranged centrally in the flame which is connected to the container and made of material with the same thickness as the container, so that it can be formed by means of punching in the relevant section of a container which from the beginning was made in one piece.

BRIEF DESCRIPTION OF THE DRAWINGS

Examples of various embodiments of a device which has the characteristics significant for the invention will be described in the following, with reference to the accompanying drawings, in which FIGS. 1*a*–1*d* in perspective, viewed obliquely from below and in principle show parts of four different embodiments of the flame distributor, FIG. 2*a* in a horizontal view and from below shows a design of the embodiment according to FIG. 1*a*, FIG. 2*b* in a vertical view shows a section of first parts of the embodiment according to FIG. 2*a*, FIG. 2*c* in a vertical view shows a section of second parts of the embodiment according to FIG. 2*a*, FIG. 3 in a vertical view shows parts of a design of the embodiment according to FIG. 1*c*, FIG. 4 in a vertical view shows parts of a design of the embodiment according to FIG. 1*d*, FIG. 5*a* in a horizontal view shows an embodiment of the container together with the flame distributor, which differs from embodiments according to FIGS. 1*a*–4, FIG. 5*b* in an end view shows the container and the flame distributor according to FIG. 5*a*, and FIGS. 6*a*–7*b* in various views show designs of flame distributors that can be fastened in a container

DESCRIPTION OF THE PREFERRED EMBODIMENTS

The illuminating charge which is utilized in the present case is of the type shown by the Swedish Pat. No. 345,845, which illuminating charge at efficient combustion without a flame distributor contains reducing agent in the form of magnesium with a content of about 57% (percent by weight), oxidizing agent in the form of sodium nitrate in a quantity of about 38% (percent by weight) and organic additive in a content of about 5% (percent by weight) which organic additive in this case is not regarded as an actual reducing agent.

In the present case, however, the illuminating charge, in relation to the normal case for efficient combustion without a flame distributor, is provided with a substantial excess of the metallic reducing agent in relation to the oxidizing agent, and the magnesium content (content of reducing agent) in each designing case is to be chosen between 60 and 72%, particularly between 61 and 69%.

Said percentages are chosen in dependence on the descending speed and the deflection angles in relation to the axis of rotation for the deflected sections of the flame, the rate of spin of the flare unit, etc. As examples of the descending speed may be mentioned values of approx. 4 m/s, although tests have shown that a particularly favourable light emission is obtained at values which are lower, e.g. 2m/s. It has thus been shown that an improvement obtained of 50% at 4 m/s can be increased to a 75% improvement at 2 m/s, while for previously known flame distributors, negative results are obtained at said lower descending speeds.

The choice of the excess content of the magnesium, as well as the other parameters mentioned, is also to a certain extent dependent on the type of flame distributor according to the invention which is utilized.

Through said composition of the illuminating charge, at the combustion of the illuminating charge, a great excess of unburnt reducing agent (magnesium) together with the flame gases will pass by and be spread out by the flame distributor into contact with the oxygen in the air and will be combusted with this in the outer parts of the flame, whereby flames with a greater energy content are obtained than would have been possible to achieve with hitherto known devices.

In accordance with the embodiments described in the following of the flame distributor disc and the openings formed in this for the outgoing flame gases from the illuminating charge, a heavy turbulence is achieved of said flame gases and unburnt excess of reducing agent, which heavy turbulence involves an extremely pronounced admixture of the surrounding air and therewith very efficient combustion of the excess of reducing agent. In addition to a higher temperature and, accordingly, a correspondingly increased radiation from the flames, improved light emission is obtained, as the flames give a uniform and widely diffused light which is independent of pendulum movements that occur in the flare unit (parachute + illuminating charge equipment).

Figure 1A:
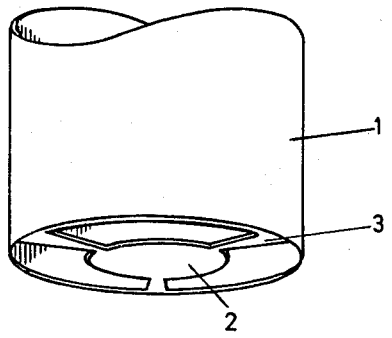

The principle of an embodiment preferred at present of a flame distributor is shown in FIG. 1*a*. A container enclosing an illuminating charge is indicated with the numeral 1. At the lower end of the container a flame distributor is arranged which has the form of a thin solid disc 2 arranged substantially at the end plane of the container which is applied centrally in said end plane and is formed by means of openings in the disc which also leave spoke-formed sections 3 which connect the peripheral parts of the disc with the wall of the container. Said openings are elongate and arc-formed, and are located at the wall of the container and constitute a passage for the flame gases developed by the illuminating charge and unburnt excess of reducing agent. The openings and the part 2 or disc have been given such extents in the plane in question in which they extend that the flame emitted from the end surface of the illuminating charge is choked about 30%, in relation to the case when the container 1 does not have any flame distributor at all. Due to the position and design of the flame distributor and the excess content of magnesium in the illuminating charge, said disc and spoke-formed sections can be made of steel plate, with a thickness of about 1 mm, without the flame distributor being burned to pieces during the combustion of the illuminating charge. This, in turn, involves that the spoke-formed sections can be punched out of a container which has previously been drawn in one unit. Such punching can be carried out in a way which is known in itself, and with tools that are known in themselves.

Figure 1B:
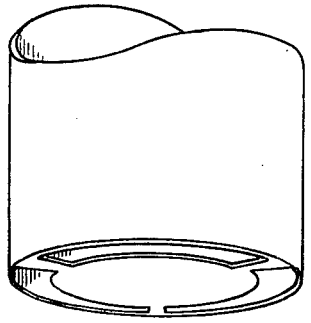

FIG. 1*b* shows an embodiment of the flame distributor which has a design corresponding to the design according to FIG. 1*a*, but with the difference that the disc with the spoke-formed sections has a greater extent in the plane in question in which it extends, and is chosen so that a choking of about 60% of the flame is obtained.

The gas velocity and the deflection of the flame is dependent on the extent of the disc, while the spoke-formed sections achieve a reliable mechanical securing of the disc that serves as a flame distributor. The number of spoke-formed sections can be varied, and can alternatively be two, four, five etc. The remaining openings or punched-out sections in the end surface of the container are related to the excess content of reducing agent in the charge. The smaller the openings, the greater the excess content within the range of excess content stipulated.

Figure 1C:
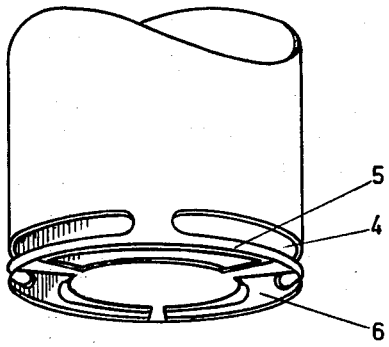

FIG. 1*c* shows a case where the flame distributor, in addition to said disc and spoke-formed sections, also comprises sections 5 achieved by means of slots 4 extending peripherally in the side wall of the container, which sections in the case consist of a remaining, comparatively thin edge. In the case shown, there are three slots, which three slots extend along the major portion of the periphery of the container, with only small, intermediate parts 6. The disc and the spoke-formed sections have been turned at such an angle in relation to the slots that the fastening parts of the spoke-formed sections in the container are located at the central parts of the slots, which gives a favourable form of the flame emitted. In the case shown in FIG. 1*c*, the disc and its spoke-formed sections, as well as the slots, have been given such extents that a choking of about 25% is obtained of the flame emitted. The height of the slots has been chosen within the range of 5–12 mm, and preferably about 7 mm.

Figure 1D:
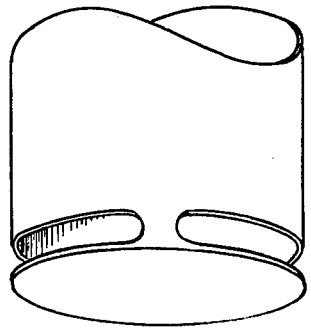

FIG. 1*d* shows an example where the disc covers the end surface of the container entirely, and where the choking function is obtained only by means of slots, of which there are assumed to be three in this case, although only two slots are shown in the figure. A choking of about 65% is obtained in this case. The height of the slots is to be chosen so that it will be certain that full ignition of the illuminating charge is obtained. In this case, the height of the slots is chosen within the range of 8–15 mm, and preferably about 10 mm.

Figure 2C:
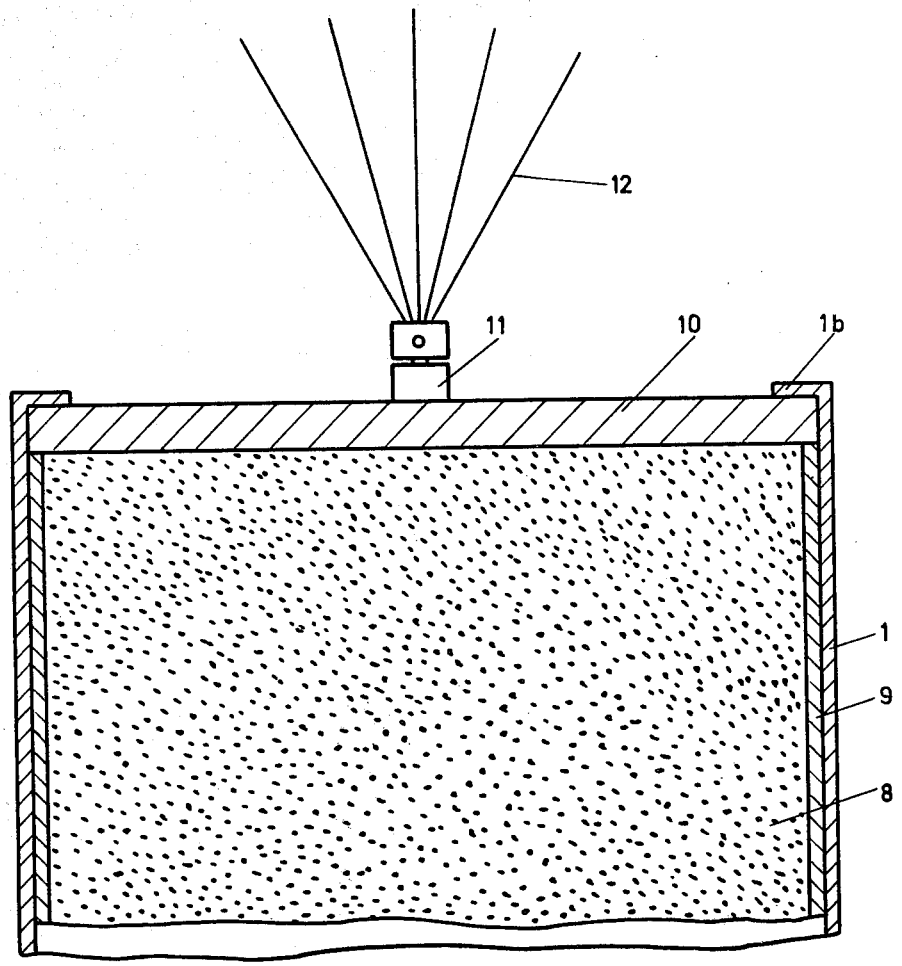

FIGS. 2*a*, 2*b* and 2*c* are intended to show the flame distributor according to the principle shown in FIG. 1*a*, and are also applicable, in principle, to the embodiment according to FIG. 1*b*. The container is made of conventional material used for the purpose, 1 mm steel plate, and the disc 2 and the spoke-formed sections have been achieved by means of punching in the part in question of the container which, from the beginning, was made in one single unit. The thicknesses of the various parts are shown with "a". The disc is solid and circular, and is arranged centrally in relation to the longitudinal axis 7 of the container. The radius R of the disc is chosen in dependence on the choking of the flame desired in each designing case. In the case shown, the spoke-formed sections are arranged with an angle v between them of 120°, and are widened outwards, counted from where they are fastened in the disc 1 to where they are fastened at the end surface of the container. The respective spoke-formed section can be considered to consist of the outer part of a sector with the angle u chosen at approx. 15°–20°. In the case shown, said disc or part 2 and the spoke-formed sections are enlcosed entirely by the edge 1*a* of the container, but it is also possible that the container can be ground down along parts of or the entire distance b between the different spoke-formed sections. It is also essential that the inner wall of the container at the flame distributor is as flat as possible, and in the ideal case there should be an entirely smooth inner wall. The junction between the respective section 3 and the disc 2 is made with a radius "*r*" of about 5 mm.

The illuminating charge is indicated with the numeral 8, and a plastic insulation encircling the charge is designated 9. The plastic insulation is intended to prevent ignition over the envelope surface of the charge, which ignition could take place from the flash via a slot in the practical case between the outer wall of the charge and the inner wall of the container.

In order to achieve appropriate combustion of the illuminating charge, even in the initial stage, it is essential that there is a slot between the inner surface of the disc 2 and the surface of the illuminating charge which faces the disc 2 even before the illuminating charge has been ignited. Tests have shown that this slot should be 2–15 mm, which guarantees that the ignition procedure will gain way rapidly.

FIG. 2*c* is intended, for the sake of completeness, to show the configuration of the illuminating charge in the connection shown, although the parts shown in FIG. 2*c* are not directly concerned with the present invention. At the end where the illuminating charge is fastened it is applied to a disc 10 which supports a swivel 11 for the fastening of the parachute, which is symbolized with its cords 12. The container is fastened to the plate 10 via an edge 1*b* which is folded in. The parts according to FIG. 2*c* are known in themselves.

Figure 3:
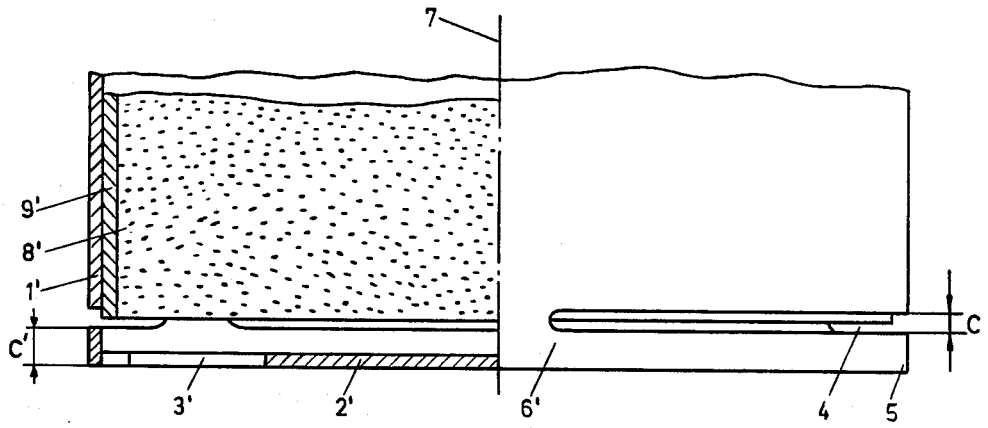

FIG. 3 is intended to show a designing example of the principle according to FIG. 1*c*, in which the parts corresponding to those in FIGS. 2*a* and 2*b* have been given the same reference designations but in the present figure have been supplemented with prime signs. Parts corresponding to those shown in FIG. 1*c* have been given the same reference designations as in this last-mentioned figure. The disc 2' and the spoke-formed sections 3' have the same design, in principle, as described for the embodiment shown above. The number of slots 4 is three, and they are equally distributed along the periphery of the container. The total length of the slots substantially occupies the periphery of the container. The height of the slots is indicated with *c*, and the height of the edge 5 left by the slots with "*d*". In the example of the embodiment, the height of the edge 5 is somewhat greater than the height "*c*" of the slots. The remaining material 6 is dimensioned so that in each designing case it will be certain that the edge 5 is retained. As in the case of the disc 2' and the spoke-formed sections 3', said slots can be punched out of the material of the container in a way which is known in itself.

Figure 4:
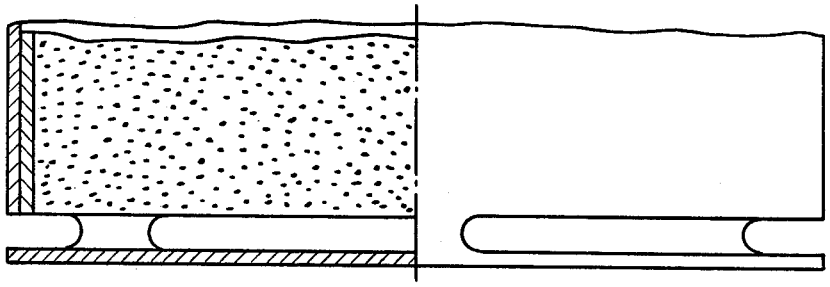

The slots in this embodiment according to FIG. 4 which correspond to those in FIG. 1*d* have the same design in principle as those mentioned above, and can be arranged in the same way and with the same means. In this case, the bottom surface of the container has been left intact.

Figure 5B:
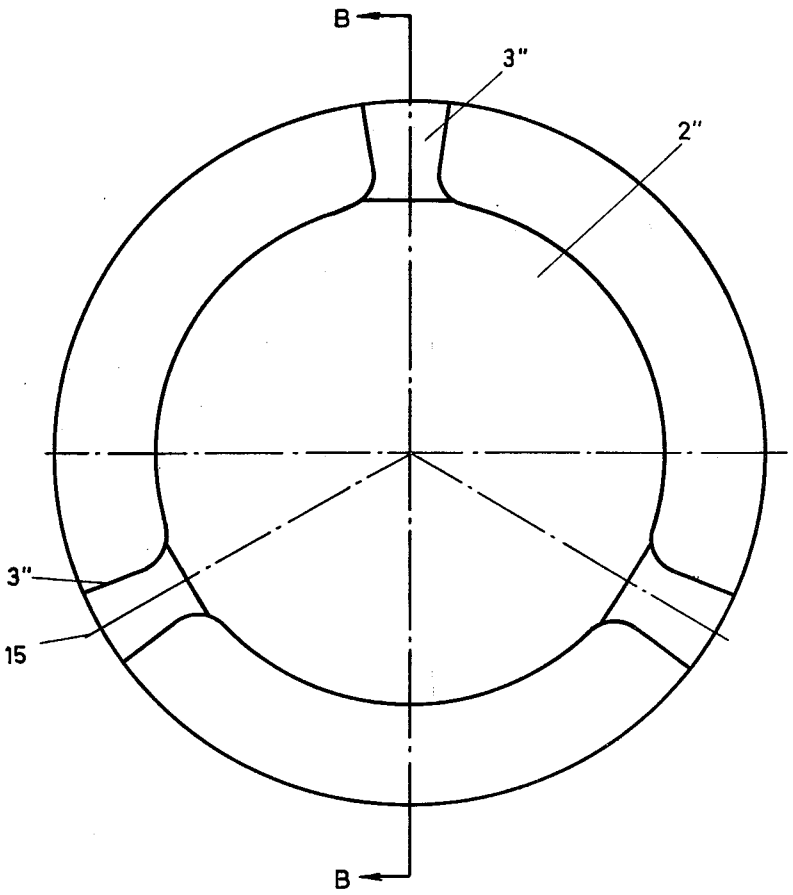
Figure 5A:
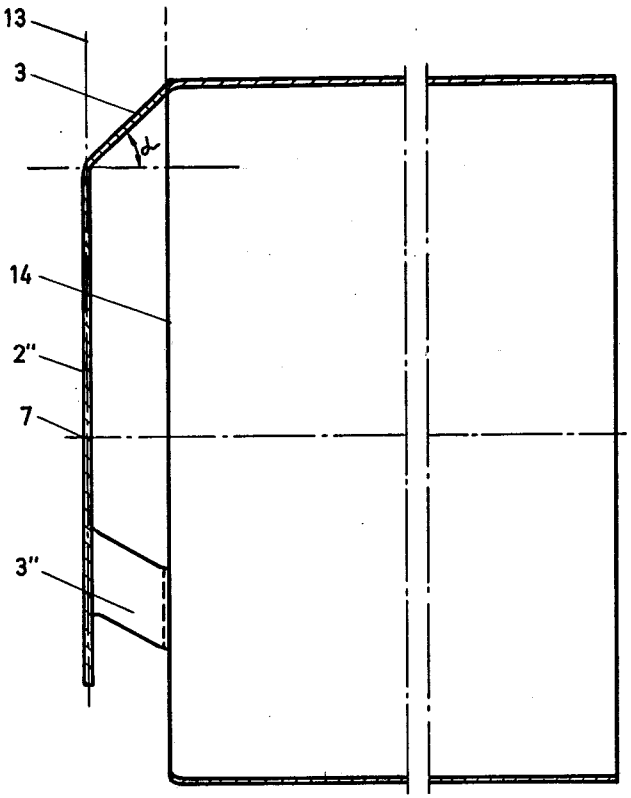

FIGS. 5*a* and 5*b* are intended to show an embodiment of the flame distributor which differs from the embodiments described above (according to FIGS. 1*a*, 1*b* and 1*c*) which have in common that the flame distributor and the spoke-formed sections are arranged in one plane which substantially coincides with the end plane of the container in cases when a grinding down or the like has not been carried out between the spoke-formed sections. In the present case, the disc 2' is arranged in a plane 13 which is parallel to the end plane 14 of the container, whereby the spoke-formed sections 3' with their respective centre line 15 will assume an angle $\alpha$ in relation to the axis of rotation 7 of the container.

Also the openings in the flame distributor according to FIGS. 5*a* and 5*b* can be punched out of the part in question of a container made in one piece. However, it is possible that the disc 2'' with its spoke-formed sections is made in one unit and is thereafter fastened in a container which does not have any end surface, by means of welding, riveting etc., which fastening takes place at the free ends of the spoke-formed sections. In cases when welding is used, the application of the flame distributor and the spoke-formed sections can be carried out by means of friction welding, ultrasonic welding etc.

Figure 6B:
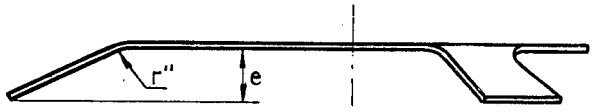
Figure 6A:
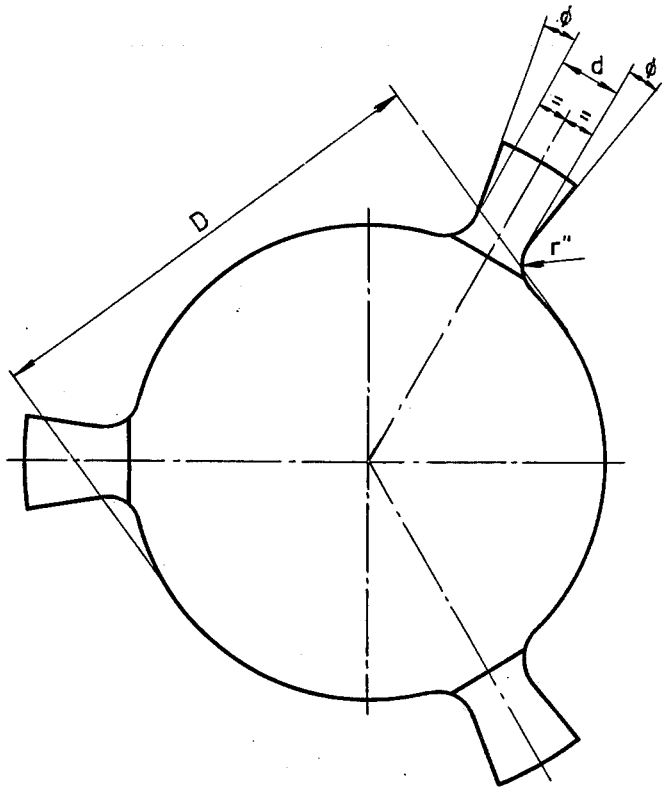

FIGS. 6*a*–7*b* are intended to show embodiments of a high and a low flame distributor which can be applied to a container intended for an illuminating charge and which does not have any bottom. In FIGS. 6*a* and 6*b*, which show the case with a high flame distributor the diameter of the disc is illustrated with "D," while the distance for the junction between the disc and the spoke-formed section is indicated with *d*. From said junction, the spoke-formed section widens with an angle $\phi$. The disc and the section mentioned have a thickness of approx. 1 mm, while $d$ = approx. 11 mm, $r'$ = 6 mm, $r'$ = 4 mm and a distance $e$ = 5–15 mm, preferably 9–13 mm. The angle $\phi$=approx. 10° before the spoke-formed section has been bent, and the diameter D=approx. 80 mm.

Figure 7B:
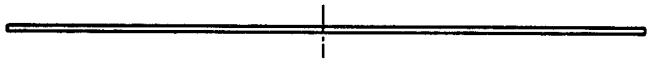
Figure 7A:
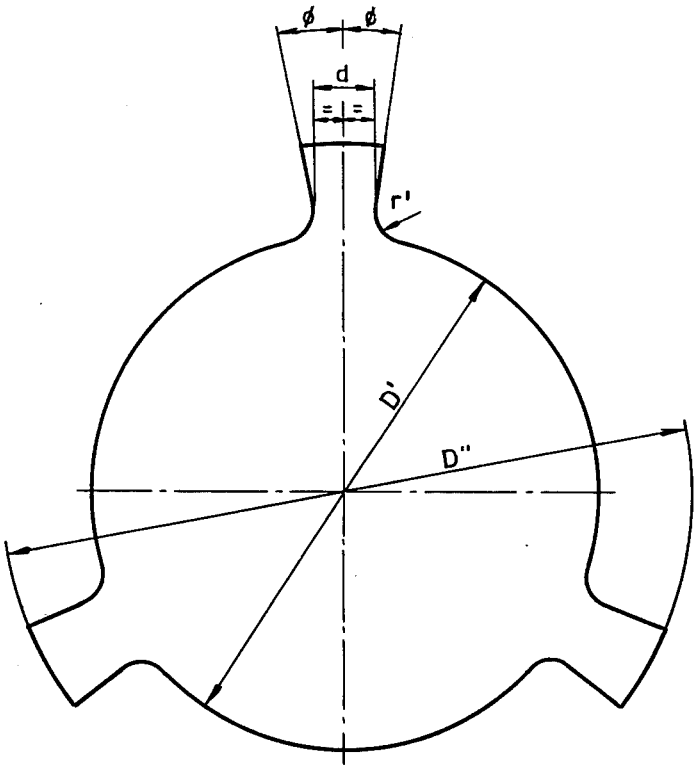

In the low embodiment of the flame distributor according to FIGS. 7*a* and 7*b*, the angle $\phi$ and $r'$ have the same value, while the diameter D' of the disc = approx. 86 mm and the diameter D'' of the spoke-formed sections = approx. 118 mm.

With the illuminating charge described above, particularly with the embodiments according to FIGS. 1*a* and 1*b*, considerable advantages can be obtained as regards improved luminous intensity and efficiency. At tests, it has moreover been established that the great smoke puffs that occur during the combustion of illuminating charges without flame distributors will not be as noticeable, which results in, among other things, a considerably smoother luminous intensity curve.

The invention is not limited to the embodiments shown above as examples, but can be subject to modifications within the scope of the following claims.

We claim:

1. An improved pyrotechnical illuminating apparatus of the type adapted for use in parachute flares, comprising:

an essentially cylindrical container for an illuminating charge, said container having an open end from which light-emitting flame gases and other products of combustion issue in use;

flame distributing disc means arranged across said open end for spreading said flame gases radially outwardly as they issue from said container to create a turbulent admixture of air and the gases and other products issuing from said container during combustion; and an illuminating charge located within said container which comprises a metallic reducing agent, an oxidizing agent and a bonding agent, the quantity ratio of the reducing agent to the oxidizing agent being substantially greater than the ratio for such a charge would be for efficient combustion in an apparatus having no such flame distributing disc means arranged to spread flame gases and other products of combustion, whereby a substantial excess of reducing agent is carried unburned from said container with the flame gases generated upon combustion of said charge; is spread out by said flame distributing disc means; and is mixed turbulently with the surrounding air in the outer portions of the flame gases, the quantity of said substantial excess being sufficient to produce high intensity light emitting flames.

2. Apparatus according to claim 1, wherein said flame distributing disc means comprises a disc arranged across said opening, said disc having a plurality of through holes for creating turbulent flow.

3. Apparatus according to claim 2, wherein said disc is made of comparatively thin material.

4. An apparatus according to claim 1, wherein said illuminating charge comprises 61 to 69 percent by weight magnesium, 5 percent by weight bonding agent and a quantity of sodium nitrate.

5. Apparatus according to claim 2, wherein said container and said disc are formed as one unit and said through holes are sized to minimize clogging as said flame gases, said other products of combustion and said substantial excess of reducing agent pass therethrough.

6. Apparatus according to claim 3, wherein said container and said disc are formed as one unit and said through holes are sized to minimize clogging as said flame gases, said other products of combustion and said substantial excess of reducing agent pass therethrough.

7. Apparatus according to claim 2, wherein said open end defines one plane and said disc defines another plane spaced from said one plane, said holes extending between said planes.

8. Apparatus according to claim 3, wherein said open end defines one plane and said disc defines another plane spaced from said one plane, said holes extending between said planes.

9. Apparatus according to claim 5, wherein said open end defines one plane and said disc defines another plane spaced from said one plane, said holes extending between said planes.

10. Apparatus according to claim 2, wherein said container and said disc are of material having substantially the same thicknesses.

11. Apparatus according to claim 2, wherein said openings are elongated and arc-formed, and extend adjacent to the wall of said container.

12. Apparatus according to claim 5, wherein said openings are elongated and arc-formed, and extend adjacent to the wall of said container.

13. Apparatus according to claim 7, wherein said openings are elongated and arc-formed, and extend adjacent to the wall of said container.

14. Apparatus according to claim 2, wherein said openings are sized to choke the flow of said flame gases, said other combustion products and said excess reducing agent to the range of 25 to 70 percent of unrestricted flow.

15. Apparatus according to claim 5, wherein said openings are sized to choke the flow of said flame gases, said other combustion products and said excess reducing agent to the range of 25 to 70 percent of unrestricted flow.

16. Apparatus according to claim 11, wherein said openings are sized to choke the flow of said flame gases, said other combustion products and said excess reducing agent to the range of 25 to 70 percent of unrestricted flow.

17. Apparatus according to claim 1, wherein said substantial excess of reducing agent is in the range of 3 to 15 percent by weight.

18. Apparatus according to claim 14, wherein said substantial excess of reducing agent varies inversely with the flow area of said openings.

19. Apparatus according to claim 15, wherein said substantial excess of reducing agent varies inversely with the flow area of said openings.

20. Apparatus according to claim 11, wherein said substantial excess of reducing agent varies inversely with the flow area of said openings.

* * * * *